US005487289A

United States Patent [19]

Otto, III et al.

[11] Patent Number: 5,487,289

[45] Date of Patent: Jan. 30, 1996

[54] LOCK ASSEMBLY

[75] Inventors: John G. Otto, III, Grandville; Ronald W. Vanderwall, Hudsonville; Eugene R. Hamilton, Walker; Kevin O. Osborn, Mattawan, all of Mich.

[73] Assignee: Herman Miller, Inc., Zeeland, Mich.

[21] Appl. No.: 82,588

[22] Filed: Jun. 23, 1993

[51] Int. Cl.[6] ..... E05B 47/06

[52] U.S. Cl. ..... 70/279; 70/210; 70/276; 70/283; 292/150

[58] Field of Search ..... 70/276, 277, 278, 70/279, 283, 210, 483–485; 292/42, 150, 359

[56] References Cited

U.S. PATENT DOCUMENTS

| | | | |
|---|---|---|---|
| 483,318 | 9/1892 | Armstrong | 70/485 |
| 656,808 | 8/1900 | Carleton . | |
| 744,134 | 11/1903 | Voight | 70/483 X |
| 929,474 | 7/1909 | Northrup | 70/210 |
| 1,215,668 | 2/1917 | Lees | 70/210 |
| 1,236,124 | 8/1917 | Vervoort | 70/210 |
| 1,535,393 | 4/1925 | Ballbach | 70/485 X |
| 1,816,504 | 7/1931 | Ulrich . | |
| 1,833,572 | 11/1931 | Hardesty . | |
| 2,001,787 | 5/1935 | Lakin . | |
| 2,086,982 | 7/1937 | McCarter | 70/484 |
| 2,090,099 | 8/1937 | Bittorf et al. | 70/485 X |
| 2,510,201 | 6/1950 | Summey . | |
| 2,729,089 | 1/1956 | Pelcin . | |
| 2,996,322 | 8/1961 | McClellan . | |
| 3,677,043 | 7/1972 | Cox | 70/92 |
| 3,863,965 | 2/1975 | Vickers | 292/66 |
| 3,907,343 | 9/1975 | Goodwin | 292/33 |
| 3,967,846 | 7/1976 | Schlage | 292/359 |
| 3,991,595 | 11/1976 | Bahry et al. | 70/120 |
| 4,015,454 | 4/1977 | Struble | 70/2 |
| 4,147,044 | 4/1979 | Bernath | 70/119 |
| 4,267,942 | 5/1981 | Wick, Jr. et al. | 221/2 |
| 4,306,432 | 12/1981 | Ravid | 70/120 |
| 4,468,943 | 9/1984 | Beattie et al. | 70/302 |
| 4,470,277 | 9/1984 | Uyeda | 70/118 |
| 4,679,415 | 7/1987 | Spratt | 70/118 |
| 4,714,030 | 12/1987 | Cole | 109/61 |
| 4,762,212 | 8/1988 | Fish et al. | 192/24 |
| 4,848,115 | 7/1989 | Clarkson et al. | 70/276 |
| 4,939,915 | 7/1990 | Vonlanthen | 70/279 X |
| 4,955,672 | 9/1990 | Pham | 312/107.5 |
| 5,069,511 | 12/1991 | Swets et al. | 312/107.5 |

FOREIGN PATENT DOCUMENTS

| | | | |
|---|---|---|---|
| 652904 | 5/1951 | United Kingdom . | |
| 2024922 | 1/1980 | United Kingdom | 70/277 |

*Primary Examiner*—Lloyd A. Gall

*Attorney, Agent, or Firm*—Willian Brinks Hofer Gilson & Lione

[57] ABSTRACT

A lock assembly for locking a door to a frame element, comprising a rotatable locking element and a locking rod connected to the rotatable locking element. Rotation of the locking element in one sense results in the locking rod moving toward a first side of the frame element and rotation in the other sense results in the locking rod moving away from the first side of the frame element. The lock assembly also comprises a pin having a first end and a second end, wherein the first end selectively engages the rotatable locking element at an engagement position so that the locking element is prevented from rotating. The lock assembly comprises a pin actuating mechanism for moving the pin from the engaged position to a disengaged position wherein the pin does not engage the locking element. The lock assembly further comprises a rotatable cam having a striking surface to strike the second end of the pin when the pin is at the disengaged position causing the first end of the pin to contact and ride along the surface of the rotatable locking element as it rotates.

27 Claims, 6 Drawing Sheets

LOCK ASSEMBLY

FIELD OF THE INVENTION

The present invention relates to a lock assembly for locking a door to a frame element. The lock assembly is capable of locking and unlocking a door automatically or manually.

BACKGROUND OF THE INVENTION

In many situations, it is desired to control access to the contents of a cabinet, drawer, or cart. For example, access to such materials as drugs and narcotics should be available only to authorized personnel. Controlled access can be accomplished electronically by providing access only to people who input a correct password or have a correct identification badge or card electronically scanned by an electronic device, such as a bar code reader. One disadvantage of some of the above-mentioned locking mechanisms is that they are unable to provide access to medical materials to an individual in an emergency situation when that person lacks the proper identification.

Another disadvantage of some of the above-mentioned locking mechanisms is that they must be electronically locked as well by repeating the process of inputting a password or scanning an identification card.

Accordingly, it is an object of the present invention to provide a lock assembly capable of being locked and unlocked both manually and automatically. Another object of the present invention is to allow one to close a door when the lock assembly is locked.

SUMMARY OF THE INVENTION

With the above objects in mind, one aspect of the present invention is directed to a lock assembly for locking a door to a frame element. The lock assembly comprises a rotatable locking element and a locking rod connected to the rotatable locking element. Rotation of the locking element in one sense results in the locking rod moving toward a first side of the frame element and rotation in the other sense results in the locking rod moving away from the first side of the frame element. The lock assembly also comprises a pin having a first end and a second end, wherein the first end selectively engages the rotatable locking element at an engagement position so that the locking element is prevented from rotating. The lock assembly comprises a pin actuating mechanism for moving the pin from the engaged position to a disengaged position wherein the pin does not engage the locking element. The lock assembly further comprises a rotatable cam having a striking surface to strike the second end of the pin when the pin is at the disengaged position causing the first end of the pin to contact and ride along the surface of the rotatable locking element as it rotates.

Another aspect of the present invention is a lock assembly comprising a rotatable locking element and a locking rod connected to the rotatable locking element. The locking element and locking rod are connected so that rotation of the locking element in one sense results in the locking rod moving toward a first side of the frame element and rotation in the other sense results in the locking rod moving away from the first side of the frame element. The lock assembly also comprises a pin having a first end and a second end, wherein the first end selectively engages the rotatable locking element at an engagement position so that the locking element is prevented from rotating. The locking assembly further comprises a lifting mechanism having an engagement piece to engage the second end of the pin causing the first end of the pin to move from the engaged position to a disengaged position wherein the pin does not engage the rotatable locking element.

DETAILED DESCRIPTION OF DRAWINGS

DETAILED DESCRIPTION OF PREFERRED EMBODIMENT

Figure 1:
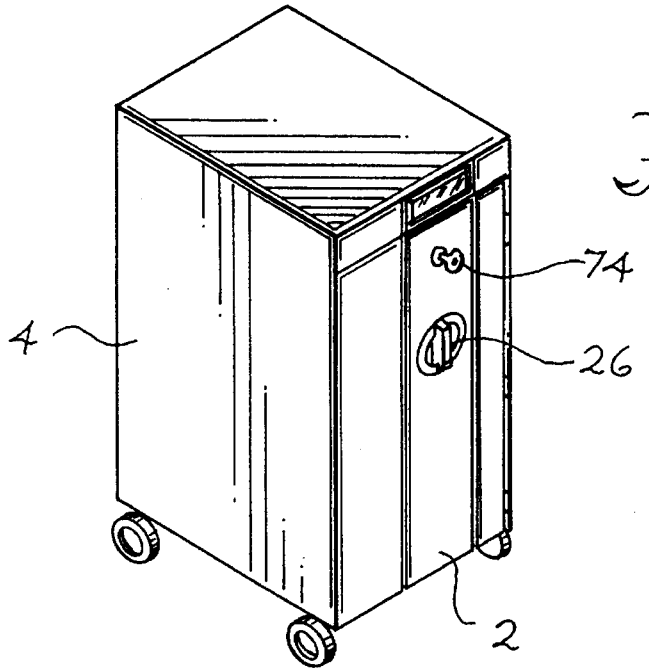
FIG. 1 is an embodiment of a cart employing an embodiment of a lock assembly according to the present invention.

The present invention is best understood upon viewing a preferred embodiment illustrated in FIGS. 1–10. The lock assembly of the present invention may be employed to open, close, and lock a door 2 which may be attached to a number of devices, such as a cabinet or a cart 4 as shown in FIG. 1.

Figure 2:
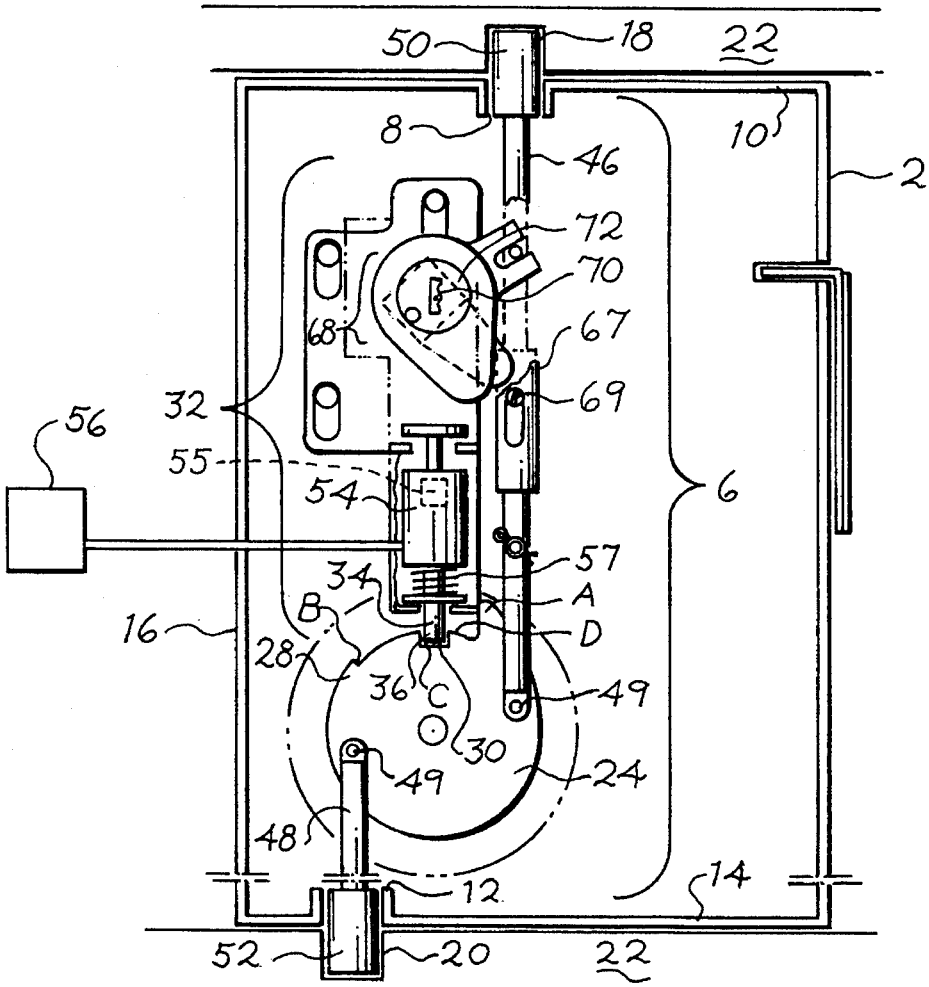
FIG. 2 is a cut-away view as one looks outside to inside of a closed door employing an embodiment of a lock assembly in a locked position according to the present invention.
Figure 3:
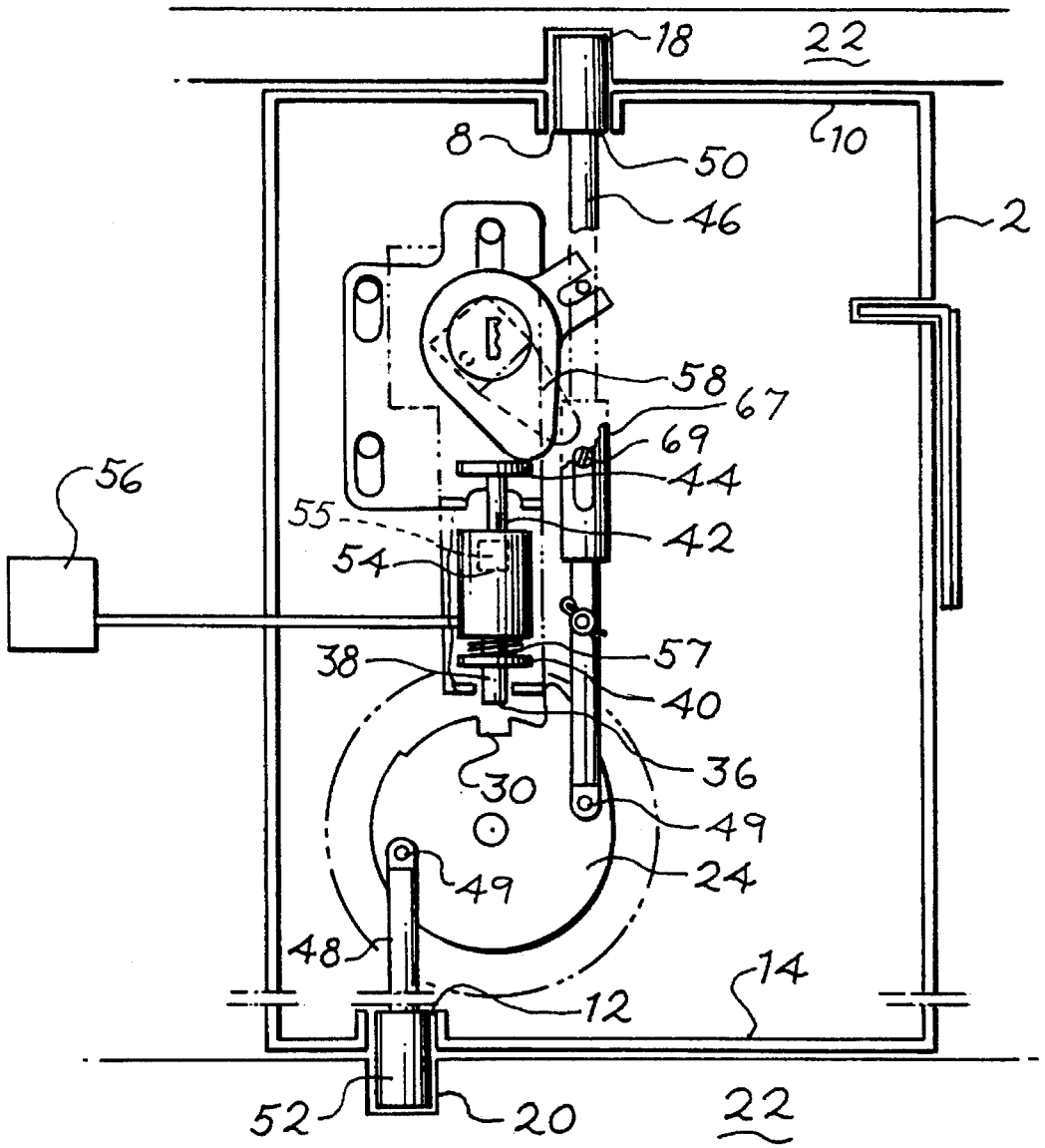
FIG. 3 illustrates the embodiment of the lock assembly of FIG. 2 when unlocked automatically.

As seen in FIG. 2, the lock assembly 6 is positioned in the interior of door 2. Door 2 may be made of a resilient material, such as aluminum, and have a size appropriate for a cart, such as being approximately 7"×2½"×34". However, one would understand that the materials for the door and the size of the door 2 are only limited by the intended purpose for the door 2. Door 2 has a top opening 8 located at the top surface 10 of the door 2. There is also a bottom opening 12 located at the bottom surface 14 of door 2. The bottom opening 12 and top opening 8 are offset from one another. In one embodiment, each opening may be cylindrical having a diameter of approximately 0.56". Furthermore, in one embodiment the bottom opening 12 is approximately 1.375" from the left side 16 of door 2 and top opening 8 is approximately 3.250" from the left side 16. It is understood that the other locations for the openings are possible without departing from the spirit of the invention. The openings 8 and 12 are located so that each will be aligned with corresponding openings 18 and 20 of frame element 22, respectively, when the door 2 is closed as shown in FIGS. 1–3.

When the door is closed, one is able to lock the door 2 either automatically or manually. FIG. 2 shows lock assembly 6 locking door 2 when it is closed. Lock assembly 6 comprises a rotatable locking element 24 for allowing one to manually lock the door 2. Locking element 24 is rotatably coupled to a locking knob 26 in a well known manner. Thus, a person rotating locking knob 26 clockwise results in the clockwise rotation of locking element 24, as viewed from outside looking in. Similarly, counterclockwise rotation of locking knob 26 causes locking element 24 to rotate counterclockwise. Locking element 24 may be made of any rigid material, such as stainless steel. Locking element 24 is disk-like in shape, wherein the radius decreases steadily from a maximum value of approximately 1.620" at point A to a value of approximately 1.250" at point B. At point B, an abutment 28 is present wherein the radius has a value of approximately 1.190". From point B to point C, the radius decreases to a value of approximately 0.48". At point C and a distance of approximately 0.80" from point B, a rectangular notch 30 is present. Rectangular notch 30 has a length of approximately 0.33" and a depth of approximately 0.22" as measured from point D, which is located approximately 0.50" from point A. It is understood that other shapes and materials for locking element 24 are possible without departing from the spirit of the invention.

A pin actuating mechanism 32 is provided for locking the locking element 24 so that locking element 24 is incapable of rotating. Pin mechanism 32 accomplishes this by employing a structure which enables a pin 34 to engage notch 30, either automatically or manually. As shown in FIG. 2, once the bottom end 36 of pin 34 is inserted into notch 30, further rotation of locking element 24 is prevented. Locking element 24 is allowed to rotate when pin 34 is withdrawn from notch 30. The mechanism for insertion and withdrawal of pin 34 into and out of notch 30 will be discussed later.

In one embodiment, pin 34 comprises a rigid metallic material, such as stainless steel, and has a bottom cylindrical section 38 having a length of approximately 0.5" and a diameter of 0.25". Bottom cylindrical section 38 comprises an annular disk 40 having a diameter of approximately 0.53". Attached to the bottom cylindrical section 38 is a top cylindrical section 42 having a length of approximately 0.70" and a diameter of approximately 0.14". The end of the top cylindrical section comprises an adjustable plate 44, having a thickness of approximately 0.14" and a length of approximately 0.75" and a width of approximately 0.5". It is understood that other shapes and materials for pin 34 are possible without departing from the spirit of the present invention.

Attached to the locking element 24 are a pair of locking rods 46, 48. In one embodiment of the invention, rods 46 and 48 are each cylindrical having a diameter of approximately 0.25" and made of a rigid material, such as steel. Locking rods 46 and 48 each have bends 49 located at one end which are rotatably inserted into holes of locking element 24. At the other end of each rod 46 and 48 is attached a male element, such as spring loaded plungers 50 and 52, respectively, which engage openings 18 and 20 of frame element 22, respectively, as shown in FIGS. 2 and 3. Furthermore, when pin 34 is inserted in notch 30, rotation of locking element 24 is prevented and, thus, door 2 is locked shut since plungers 50 and 52 are prevented from disengaging openings 18 and 20, respectively.

To unlock the locking element 24 one must withdraw pin 34 from notch 30. This can be accomplished either manually or automatically. For automatic withdrawal of pin 34, pin actuating mechanism 32 comprises an electronically activated lifting mechanism, such as a latch-type solenoid 54. Latch-type solenoid 54 comprises a latch mechanism, such as a magnet (not shown), which holds the pin 34 in its withdrawn position when it is withdrawn from the notch as shown in FIG. 3. Solenoid 54 surrounds pin 34 and is connected to a control mechanism, such as variable voltage source 56. Voltage source 56 produces control signals in response to an external input, such as a bar code signal. Once a proper external input is received a control signal is produced, such as voltage pulses produced by a 12 volt battery. Automatic withdrawal of pin 34 is provided for by sending a pulse having a voltage V1 to solenoid 54 of FIG. 2. The pulse enters the solenoid 54 and produces an inductive force resulting in pin 34 being retracted from notch 30 and moving a sufficient distance to be engaged by the magnet 55 contained within solenoid 54. Once pin 34 is retracted, another pulse having voltage V2 may be sent from voltage source 56 to solenoid 54 resulting in an inductive force sufficient to overcome the attractive force of the magnet and move the pin 34 downward out of the solenoid 54. Voltage V2 may be produced in response to another external signal or in response to a predetermined time period lapsing, such as 15 seconds, in which no further action has been taken in opening or locking the door 2. A conical spring 57 may be positioned between the solenoid 54 and annular disk 40 to aid in overcoming engagement with the magnet.

To open the door 2 in the locked position of FIG. 2, one first sends voltage V1 to solenoid 54 via voltage source 56. As described previously, this results in pin 34 being retracted and held in the solenoid 54, as shown in FIG. 3. At the position of FIG. 3, cam 58 just makes contact with a corner of plate 44.

Figure 5:
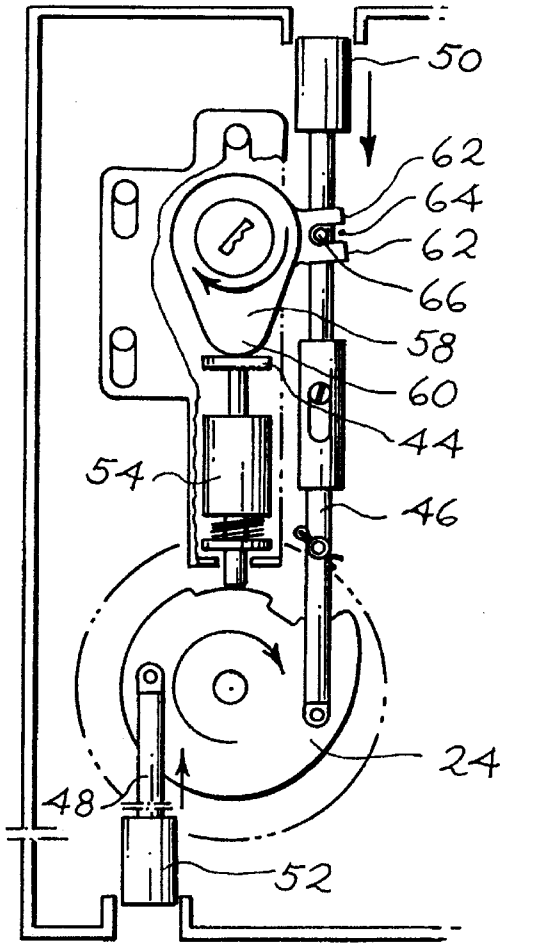
FIG. 5 illustrates an open door employing the embodiment of the lock assembly of FIGS. 4 and 7 in an engaged position according to the present invention.
Figure 4:
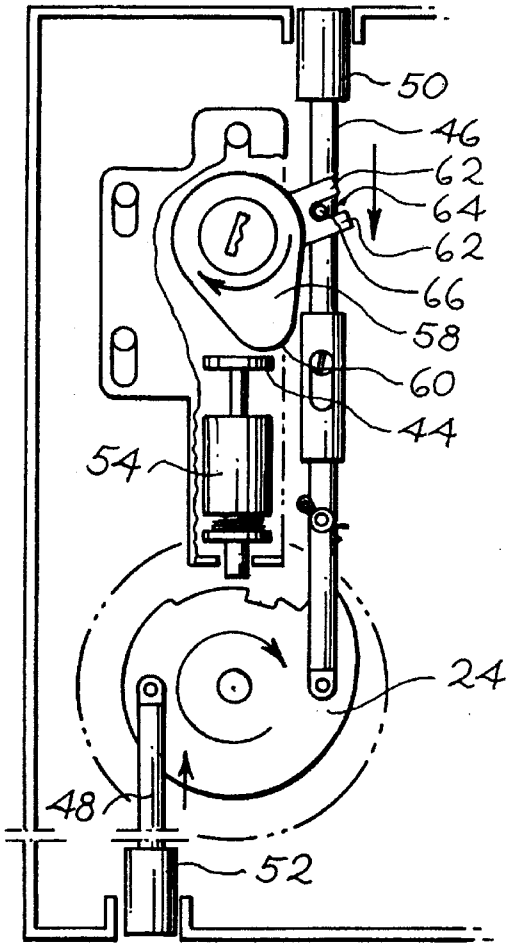
FIG. 4 illustrates the embodiment of the lock assembly of FIG. 3 when the door is opened.

As one starts to rotate locking knob 26 in a clockwise sense as viewed from outside looking in, locking element 24 rotates in a clockwise sense as well, as shown in FIG. 4. Furthermore, the initial rotation of locking element 24 results in the striking surface 60 of rotatable cam 58 striking the top end 44 of pin 34 with a sufficient downward force to overcome the magnetic attractive force, thus, allowing pin 34 to be retracted from the solenoid 54 and engage the circumferential surface of locking element 24 near notch 30. As shown in FIG. 5, further clockwise rotation of locking element 24 results in pin 34 moving away from the notch 30 and along the locking element's circumferential surface. In addition, locking rod 46 moves away from the top surface 10 of door 2, as shown in FIG. This results in plunger 50 being removed from opening 18 of frame element 22. Similarly, clockwise rotation of locking element 24 allows plunger 52 to be removed from opening 20. Thus, when the plungers are removed from the openings of the frame one can open door 2.

Cam 58 is coupled to locking rod 46 by a coupling device, such as a pair of prongs 62 attached to cam 58 and which define a channel 64 into which a connecting device, such as coupling pin 66, is inserted. Cam 58 may have many shapes. For example in one embodiment, cam 58 may be pear-shaped, wherein the striking surface 60 is located at the narrow part of the cam 58. Cam 58 also may have a line of symmetry bisecting the cam along its length and perpendicular to a line aligned with channel 64. At a distance of approximately 0.88" from the striking surface 60, the cam 58 is pivotally connected to a lock barrel. As seen in FIG. 3, when the door 2 is closed striking surface 60 abuts on plate 44 resulting in pin 34 engaging notch 30 of locking element 24. If one desires to vary where striking surface 60 is positioned with respect to plate 44, one varies the vertical location of pin 66 by an adjustable sleeve 67. Sleeve 67 preferably is made of plastic and cylindrical in shape having a diameter of approximately 0.5" and a length of approximately 1.625". Sleeve 67 comprises a cylindrical opening extending along the longitudinal axis of sleeve 67. The opening has a diameter of approximately 0.25" and is in communication with a pair of oppositely facing slots arranged on the side of sleeve 67. Operation of sleeve 67 is understood upon viewing FIGS. 2 and 3, in which a top portion of rod 46 is slidingly inserted with- in the sleeve opening. Next a screw 69 is inserted through a slot and is attached to an opening of rod 46 (not shown). The slot has a rectangular-like shape with a length of approximately 0.75" and a width of approximately 0.1875". The screw is tightened along the slot in which the desired positioning of the cam 58 is achieved. The bottom of sleeve 67 has a rod inserted in the sleeve opening and is attached thereto by well known means such as screw insertion. The rod preferably is made of metal and is attached to a lower portion of rod 46 in a well known manner, such as a pin inserted between the metal rod and the lower portion of rod 46. Once attached as described, one can adjust where cam 58 strikes end 44 by varying where the screw 69 is tightened along the channel. Note that rod 48 may or may not employ a similar sleeve. Furthermore, it is contemplated that rods 46 and 48 can be continuous, i.e. used without sleeves, if they produce the desired orientation of cam 58.

Coupling pin 66 may also have various shapes, such as being cylindrical having a diameter of approximately 0.17" and a length of approximately 0.20". Coupling pin 66 may be attached via an annular collar to the locking rod 46. Thus, as locking rod 46 moves downward due to the clockwise rotation of locking element 24, the coupling pin 66 will move downward as well causing cam 58 to rotate clockwise and striking surface 60 to engage top end 44 of pin 34, as seen in FIG. 5.

Figure 6:
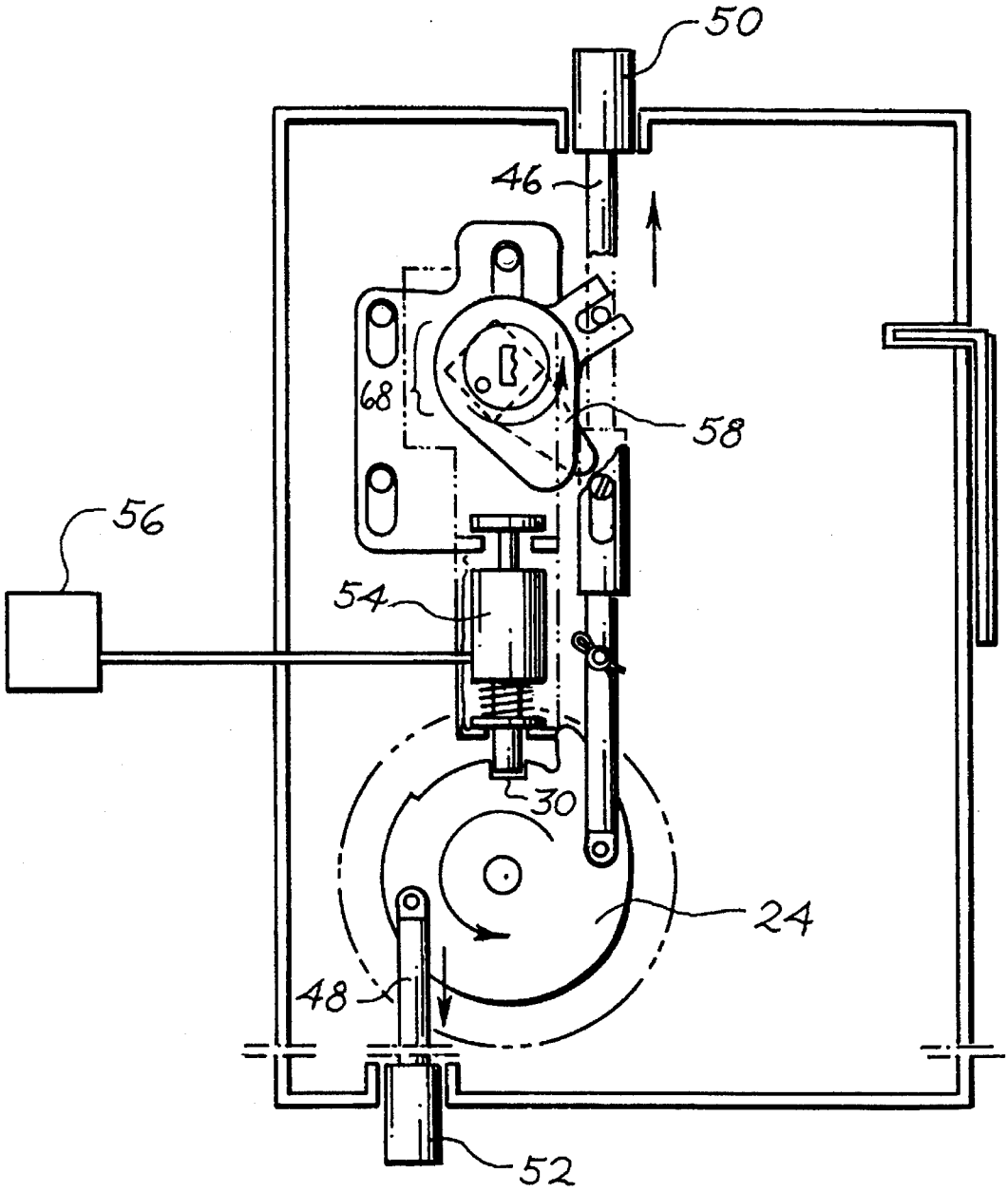
FIG. 6 illustrates an open door employing the embodiment of the lock assembly of FIGS. 5 and 8 in a locked position according to the present invention.

Once door 2 is opened, lock assembly 6 may be locked. After pin 34 is released and engages the surface of locking element 24, locking element 24 is rotated counter-clockwise so that pin 34 rides along the locking element surface until it is inserted into notch 30 as shown in FIG. 6. Counter-clockwise rotation of locking element 24 can be done either manually or by a spring mechanism, such as the spring loaded plungers 50 and 52. Once pin 34 has been inserted into notch 30, the door is open but the lock assembly 6 is locked. However, one need not unlock the lock assembly 6 to close the door. One only needs to close the door to lock the door, since plungers 50 and 52 are spring loaded allowing them to slide past the frame and enter openings 18 and 20, respectively, as shown in FIG. 2. To unlock the closed door 2, one sends a pulse having voltage V2 from voltage source 56, as described previously.

In some emergency situations one may not be able to open the locked door 2 automatically. To allow for the opening of the door 2 in such a situation, the present invention provides for manual movement of pin 34 to selectively disengage the rotatable locking element 24. Manual movement of pin 34 is provided through key mechanism 68. Key mechanism 68 comprises an exterior key hole 70 located on the exterior of the door 2 and which is integral with a rotatable engagement piece 72 and shaped to have a key 74 inserted therein. Rotatable engagement piece 72 is contained within an annular element which is stationary at all times. Furthermore, cam 58 comprises a collar which snugly fits around the stationary annular element so that cam 58 rotates about the annular element.

Insertion and rotation of key 74 allows engagement piece 72 to rotate. In one embodiment, a second cam 73 is attached to an end of engagement piece 72 by well known means such as a nut and bolt. Thus, cam 73 and engagement piece 72 both rotate in the same sense that the key 74 rotates.

Figure 7:
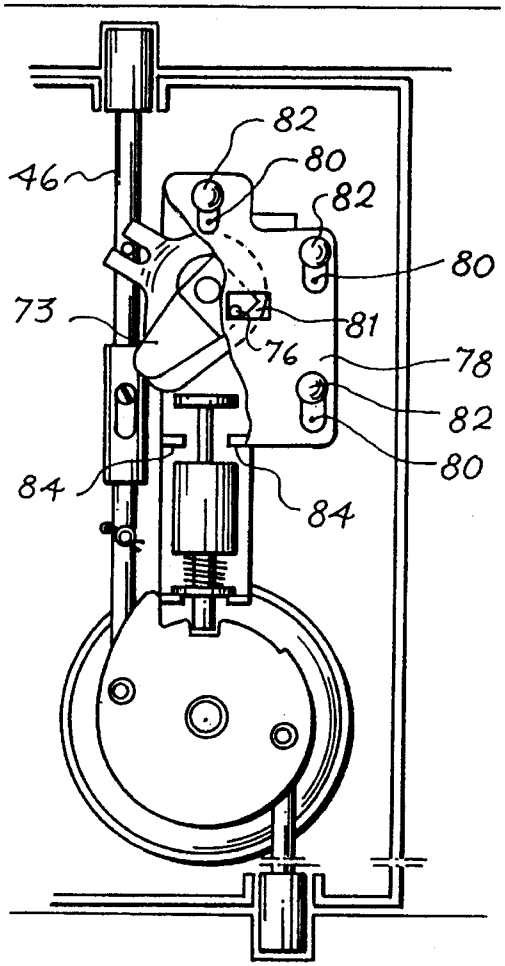
FIG. 7 illustrates the embodiment of the lock assembly of FIG. 2 as one from the inside of the door looks outside.

Cam 73 comprises a contact element, such as cylindrical pin 76, which contacts a manually activated lifting mechanism, such as sliding plate 78. Sliding plate 78 comprises one or more vertically aligned slots 80. Slots 80 have bolts 82 inserted therein so that sliding plate 78 is able to move vertically along slots 80. When the key 74 and engagement piece are not rotated as shown in FIG. 7, pin 76 lies at the lower left corner of the rectangular aperture 81 and plate 78 lies at its lowermost vertical position. Furthermore, a contact portion of cam 73 is not aligned with end 44 of pin 34.

Figure 8:
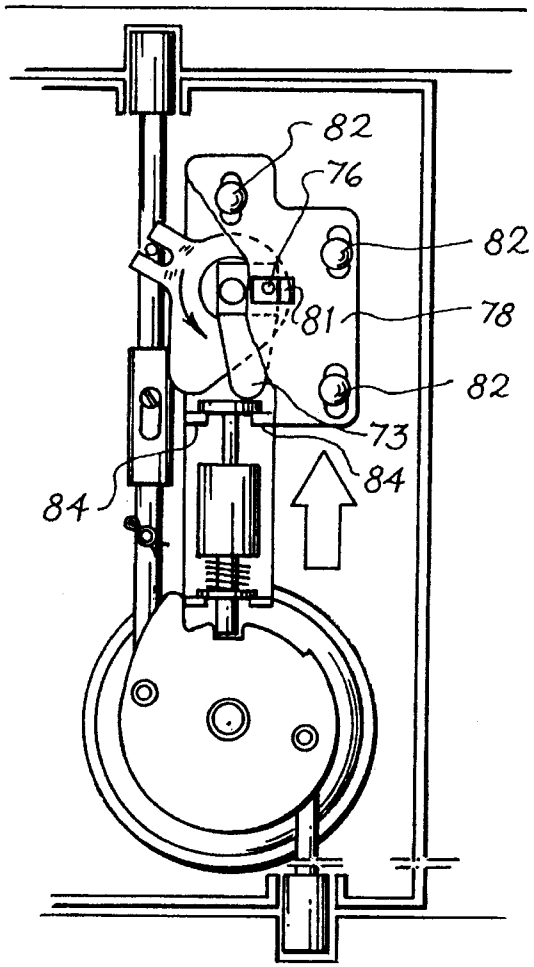
FIG. 8 illustrates the embodiment of the lock assembly of FIG. 7 when manual unlocking is initiated.

However, as viewed from inside looking out, when one begins to rotate the key 74 counter-clockwise engagement piece 72 rotates and pin 76 contacts sliding plate 78 causing plate 78 to move upward. As shown in FIG. 8, when cam 73 points downward plate 78 has vertically moved a distance equal to half the length of slot 80. Note that at this stage pin 34 has not been lifted from its engaged position.

Figure 9:
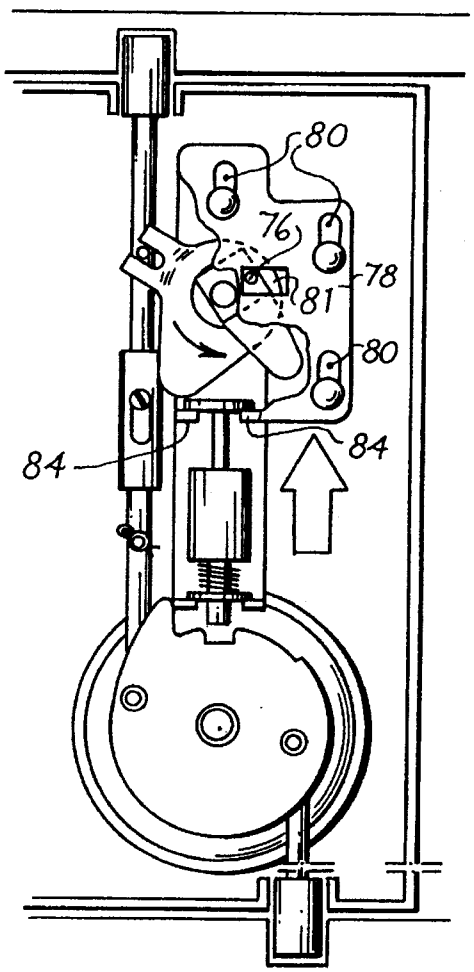
FIG. 9 illustrates the embodiment of the lock assembly of FIGS. 7 and 8 in a disengaged position.

Plate 78 also comprises one or more bottom sections 84 arranged beneath the end 44 of pin 34. When sliding plate 78 moves upward from its halfway position of FIG. 8, bottom sections 84 engage the plate 44 resulting in plate 44 and pin 34 moving upward and being disengaged from the locking element 24 resulting in the lock bar assembly being unlocked, as shown in FIG. 9. However, the pin 34 does not move a sufficient distance upward so that the magnetic latch in the solenoid 54 engages the pin 34. To manually lock the lock bar assembly 6 of FIG. 9, one rotates key 74 clockwise resulting in gravity moving plate 78 downward and pin 34 reentering notch 30 and locking the locking element 24, as shown in FIG. 2.

Once pin 34 is raised by sliding plate 78 as shown in FIG. 9, one can open the door by repeating the same steps as done in the automatic locking mode. For example, after opening door 2 one rotates locking element 24 clockwise via locking knob 26 resulting in plungers 50 and 52 being removed from openings 18 and 20, respectively, of frame element 22. This results in a configuration similar to that shown in FIGS. 4 and 5 except that the pin 34 has been raised manually, and, thus, the door 2 can be opened.

One then locks lock assembly 6 by rotating locking element 24 counter-clockwise so that pin 34 rides along the locking element surface until it is located above notch 30. The key 74 is then rotated counter-clockwise resulting in moving plate 78 downward and pin 34 reentering notch 30 and locking the locking element 24, as described previously. At this stage, the door is open but the lock bar assembly 6 is locked. As described previously, one only needs to close the door to lock the door. Once the door is closed and the plungers have engaged the openings, one removes the key 74 to prevent unauthorized people from opening the locked and closed door.

Figure 10:
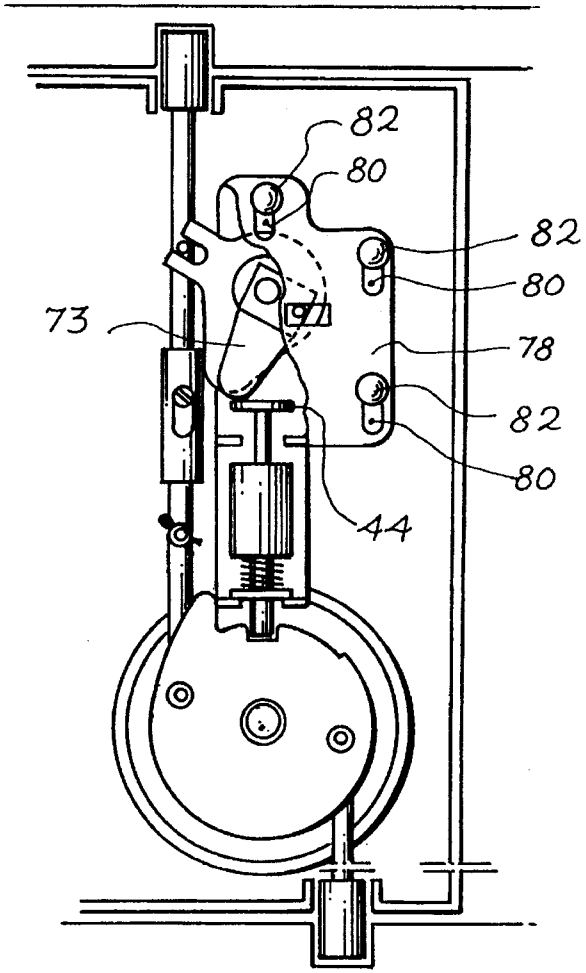
FIG. 10 illustrates the embodiment of the lock assembly of FIG. 3 when manual locking is initiated.

It should be noted that FIGS. 7–9 demonstrate one function of second cam 73. Another function of second cam 73 is that it allows one to manually lock the lock assembly of FIG. 3 should the automatic locking system be rendered inoperative. As seen in FIG. 10, in such a situation one inserts key 74 and rotates it counter- clockwise as viewed from inside looking out. This results in the striking portion of cam 73 to strike and push down plate 44 so as to overcome the attractive force exerted by the magnets of solenoid 54. Consequently, pin 34 reenters notch 30 and the lock assembly 6 is locked.

While the invention has been described with relation to certain presently preferred embodiments, those with skill in this art will recognize other modifications of the invention which will still fall within the scope of the invention, as expressed in the accompanying claims.

We claim:

1. A lock assembly for locking a door to a frame element, comprising:

a rotatable locking element;

a locking rod connected to said rotatable locking element, wherein rotation of said locking element in one sense results in said locking rod moving toward a first side of said frame element and rotation in the other sense results in said locking rod moving away from said first side of said frame element;

a pin having a first end and a second end, wherein said first end selectively engages said rotatable locking element at an engaged position so that said locking element is prevented from rotating;

a pin actuating mechanism for moving said pin from said engaged position to a disengaged position wherein said pin does not engage said locking element; and a rotatable cam having a striking surface to strike said second end of said pin when said pin is at said disengaged position causing said first end of said pin to contact and ride along a surface of said rotatable locking element as it rotates.

2. The lock assembly of claim 1, comprising a second locking rod connected to said rotatable locking element, wherein rotation of said locking element in said one sense results in said second locking rod moving toward a second side of said frame element and rotation in said other sense results in said second locking rod moving away from said second side of said frame element.

3. The lock assembly of claim 1, wherein said rotatable cam is coupled to said locking rod so that movement of said locking rod results in said cam rotating and striking said second end of said pin when said pin is in said disengaged position.

4. The lock assembly of claim 1, wherein said pin actuating mechanism comprises a lifting mechanism to move said pin from said engaged position to said disengaged position and a latching mechanism to hold said pin at said disengaged position.

5. The lock assembly of claim 4, wherein said lifting mechanism comprises a solenoid and said latching mechanism comprises a magnet to magnetically hold said pin in said disengaged position.

6. The lock assembly of claim 5, comprising a control mechanism no supply control signals to said solenoid so that said solenoid moves said pin from said engaged position to said disengaged position and vice versa in response to receipt of said control signals.

7. The lock assembly of claim 1, comprising a lifting mechanism having an engagement piece to engage said second end of said pin causing said first end of said pin to move from said engaged position to said disengaged position wherein said pin does not engage said rotatable locking element.

8. The lock assembly of claim 7, comprising a second locking rod connected to said rotatable locking element, wherein rotation of said locking element in said one sense results in said second locking rod moving toward a second side of said frame element and rotation in said other sense results in said second locking rod moving away from said second side of said frame element.

9. The lock assembly of claim 7, wherein said lifting mechanism comprises a sliding plate coupled to a key mechanism, such that when a key is inserted into said key mechanism and is rotated said key mechanism rotates causing said sliding plate to engage said second end of said pin.

10. The lock assembly of claim 7, wherein said pin actuating mechanism comprises a second lifting mechanism to move said pin from said engaged position to said disengaged position and a latching mechanism to hold said pin at said disengaged position.

11. The lock assembly of claim 10, wherein said second lifting mechanism comprises a solenoid and said latching mechanism comprises a magnet to magnetically hold said pin in said disengaged position.

12. The lock assembly of claim 11, comprising a control mechanism to supply control signals to said solenoid so that said solenoid moves said pin from said engaged position to said disengaged position and vice versa in response to receipt of said control signals.

13. A method of locking or unlocking a door to a frame element, comprising the steps of:

providing a rotatable locking element coupled to a locking rod which is positioned within a first side of said frame element;

providing a pin which is engaged with said rotatable locking element at an engaged position so that said rotatable locking element is prevented from rotating;

providing a cam coupled to said locking rod such that said cam moves in response to movement of said locking rod;

moving said pin from said engaged position to a disengaged position wherein said pin does not engage said locking element;

rotating said locking element in a first sense;

moving said locking rod away from said first side of said frame element in response to said rotation of said locking element in said first sense so as to unlock said door with respect to said frame element;

moving said cam in response to said movement of said locking rod;

striking said pin with said cam during said movement of said cam causing said pin to contact and ride along a surface of said locking element as it rotates.

14. The method of claim 13, wherein said step of moving said cam comprises rotating said cam.

15. The method of claim 13, comprising the step of rotating said locking element in a second sense until said pin engages a notch in said locking element so as to prevent said locking element from rotating.

16. The method of claim 15, comprising the step:

moving said locking rod toward said first side of said frame element in response to said rotation of said locking element in said second sense so that said locking rod is positioned within said first side of said frame element so that said door is locked with respect to said frame element.

17. The method of claim 13, comprising the step of disengaging said pin from said locking element in response to an electrical control signal.

18. A lock assembly for locking or unlocking a door to a frame element, comprising:

a rotatable locking element;

a locking rod connected to said rotatable locking element, wherein rotation of said locking element in one sense results in said locking rod moving toward a first side of said frame element and rotation in the other sense results in said locking rod moving away from said first side of said frame element;

a pin having a first end and a second end, wherein said first end selectively engages said rotatable locking element at an engaged position so that said locking element is prevented from rotating;

a lifting mechanism comprising a solenoid that causes said first end of said pin to move from said engaged position to a disengaged position; and lifting mechanism having a sliding plate coupled to a key mechanism, such that when a key is inserted into said key mechanism and is rotated said key mechanism rotates causing said sliding plate to engage said second end of said pin.

19. The lock assembly of claim 18, comprising a second locking rod connected to said rotatable locking element, wherein rotation of said locking element in said one sense results in said second locking rod moving toward a second side of said frame element and rotation in said other sense results in said second locking rod moving away from said second side of said frame element.

20. The lock assembly of claim 18, comprising a second pin to move in response to rotation of said key mechanism and engage said sliding plate so as to cause said sliding plate to move and engage said second end of said pin.

21. The lock assembly of claim 20, wherein said sliding plate comprises an opening which said second pin engages so as to cause said plate to move and engage said second end of said pin.

22. The lock assembly of claim 18, comprising a control mechanism to supply control signals to said solenoid so that said solenoid moves said pin from said engaged position to said disengaged position and vice versa in response to receipt of said control signals.

23. The lock assembly of claim 18, wherein said sliding plate moves said second end of said pin from said engaged position toward said disengaged position.

24. The lock assembly of claim 23, wherein the furthest position that said sliding plate can move said second end of said pin from said engaged position is such that said magnet is unable to magnetically hold said pin.

25. The lock assembly of claim 18, comprising a latching mechanism that comprises a magnet that magnetically holds said pin so that said pin does not engage said rotatable locking element.

26. A lock assembly for automatically locking a door to a frame element, comprising:

a rotatable locking element;

a first locking rod connected to said rotatable locking element, wherein rotation of said locking element in one sense results in said first locking rod moving toward a first side of said frame element and rotation in the other sense results in said first locking rod moving away from said first side of said frame element;

a second locking rod connected to said rotatable locking element, wherein rotation of said locking element in said one sense results in said second locking rod moving toward a second side of said frame element and rotation in said other sense results in said second locking rod moving away from said second side of said frame element;

said first and second locking rods each having an end with a compressible plunger;

a pin having a first end and a second end, wherein said first end selectively engages said rotatable locking element at an engaged position so that said locking element is prevented from rotating;

said plungers of said first and second locking rods each extending past said door when said locking element is at said engaged position and each of said plungers and frame element having a structure so that when said door nears said frame element each plunger is compressed by said frame element and slides past the frame element to engage an opening in the frame element so as to lock the door and frame element together;

a pin actuating mechanism for moving said pin from said engaged position to a disengaged position wherein said pin does not engage said locking element; and a rotatable cam having a striking surface to strike said second end of said pin when said pin is at said disengaged position causing said first end of said pin to contact and ride along a surface of said rotatable locking element as it rotates.

27. The lock assembly of claim 26, further comprising:

a lifting mechanism comprising a solenoid and a latching mechanism that comprises a magnet, said solenoid causing said first end of said pin to move from said engaged position to a disengaged position where said magnet magnetically holds said pin so that said pin does not engage said rotatable locking element.

* * * * *

UNITED STATES PATENT AND TRADEMARK OFFICE

CERTIFICATE OF CORRECTION

PATENT NO. : 5,487,289
DATED : January 30, 1996
INVENTOR(S) : John G. Otto, III et al.

It is certified that error appears in the above-indentified patent and that said Letters Patent is hereby corrected as shown below:

On the Title Page

In column 1, under "References Cited U.S. PATENT DOCUMENTS", please add the following:

--3,333,878 8/1967 Pelcin--.

In column 2, under "FOREIGN PATENT DOCUMENTS", please add the following:

--2431019 2/1980 France--.

In the Claims

Column 7, line 46,
In claim 6, line 2, delete "no" and substitute --to--.
Column 9, line 6,
In claim 18, line 17, before "lifting" insert --a second--.

Signed and Sealed this

Thirty-first Day of December, 1996

Bruce Lehman

*Attest:*

BRUCE LEHMAN

*Attesting Officer*

*Commissioner of Patents and Trademarks*